US006481584B1

(12) United States Patent
Cantley

(10) Patent No.: US 6,481,584 B1
(45) Date of Patent: Nov. 19, 2002

(54) PLASTIC PEGBOARD

(75) Inventor: Richard W. Cantley, 4703 Bentley, Troy, MI (US) 48098

(73) Assignees: Richard W. Cantley, Troy, MI (US); Antoinette Janine Cantley, Troy, MI (US)

( * ) Notice: Subject to any disclaimer, the term of this patent is extended or adjusted under 35 U.S.C. 154(b) by 0 days.

(21) Appl. No.: 09/562,124

(22) Filed: May 1, 2000

Related U.S. Application Data

(60) Provisional application No. 60/149,145, filed on Aug. 16, 1999.

(51) Int. Cl.[7] ..... A47F 5/08

(52) U.S. Cl. ..... 211/87.01; 211/59.1; 211/57.1; 248/220.31; 248/220.41

(58) Field of Search ..... 211/87.01, 59.1, 211/57.1, 194, 106; 248/220.31, 222.3, 220.41

(56) References Cited

U.S. PATENT DOCUMENTS

| | | | | | |
|---|---|---|---|---|---|
| 2,551,539 | A | | 5/1951 | Horton | 40/63 |
| 2,621,807 | A | | 12/1952 | Rendich | 214/10.5 |
| 3,306,564 | A | | 2/1967 | Nickel | 248/225 |
| 3,322,287 | A | | 5/1967 | Ragir | 211/87 |
| 3,452,959 | A | | 7/1969 | Ishikawa | 248/488 |
| 3,844,231 | A | * | 10/1974 | Peacock | 108/107 |
| 3,953,633 | A | * | 4/1976 | Nooman | 428/131 |
| 4,014,774 | A | * | 3/1977 | Nooman | 204/213 |
| 4,461,443 | A | * | 7/1984 | Dauman | 248/220.3 |
| 4,762,299 | A | * | 8/1988 | Langelier | 248/220.4 |
| 4,932,538 | A | * | 6/1990 | Gambello | 211/87 |
| 4,944,416 | A | | 7/1990 | Petersen et al. | 211/87 |
| 4,948,005 | A | * | 8/1990 | Garton et al. | 220/1.5 |
| 4,951,827 | A | * | 8/1990 | Moransais | 211/59.1 |
| 5,076,454 | A | * | 12/1991 | Garton et al. | 220/1.5 |
| 5,109,993 | A | | 5/1992 | Hutchinson | 211/87 |
| 5,138,803 | A | | 8/1992 | Grossen | 52/36 |
| 5,330,071 | A | * | 7/1994 | Parker | 220/645 |
| 5,374,466 | A | * | 12/1994 | Bleasdale | 428/131 |
| 5,556,068 | A | * | 9/1996 | Gorelik | 248/220.41 |
| 5,673,803 | A | | 10/1997 | Burback | 211/87 |
| 5,713,709 | A | * | 2/1998 | Huang | 411/442 |
| 5,922,432 | A | * | 7/1999 | Kalal | 428/80 |
| 5,927,517 | A | | 7/1999 | Lipman et al. | 211/59.1 |
| D419,697 | S | * | 1/2000 | Kroesbergen | D25/138 |
| 6,061,909 | A | * | 5/2000 | Laskowki | 29/896.6 |
| 6,109,857 | A | * | 8/2000 | Trygg | 414/626 |

* cited by examiner

*Primary Examiner*—Curtis A. Cohen
*Assistant Examiner*—Khoa Tran
(74) *Attorney, Agent, or Firm*—Gifford, Krass, Groh, Sprinkle, Anderson & Citkowski, P.C.

(57) ABSTRACT

A plastic pegboard includes a generally flat sheet of plastic material with multiple holes positioned at regular intervals. The sheet has a generally smooth front face and an opposed rear face. The rear face includes a ring projecting about each of the holes, as well as multiple ribs extending between some of the holes.

28 Claims, 4 Drawing Sheets

PLASTIC PEGBOARD

CROSS-REFERENCE TO RELATED APPLICATIONS

This application claims the benefit of United States Provisional Application having Ser. No. 60/149,145 filed Aug. 16, 1999.

FIELD OF THE INVENTION

The present invention relates generally to pegboard and, more specifically, to a pegboard molded out of plastic.

BACKGROUND OF THE INVENTION

Wooden pegboard is a popular and well known product generally consisting of a thin particle board sheet with small holes defined therethrough at regular intervals. A piece of pegboard may be supported on a vertical surface. There are a large variety of connectors which are designed to engage the holes in the pegboard and to provide hooks or brackets for attaching other devices. For example, simple hooks are available that have a first end that goes through one of the holes in the wood pegboard with the other end extending downwardly along the pegboard and then curving out away from the pegboard. The hook may also have an additional peg on the back that engages a second hole in order to stabilize the hook. Any of a variety of objects may be hung on the hook. Because the pegboard has a plurality of holes at regular intervals, the hook may be placed in any of a multitude of positions, making for easy organization.

Despite its utility and popularity, wood pegboard has multiple drawbacks. Most wood pegboard is made from a high density particle board material because the cost of this material is lower than higher quality sheets of wood or plywood. This particle board material is not very durable or strong, thereby reducing its utility. For example, portions of the pegboard will break away if subjected to an impact. Also, the holes in the pegboard tend to widen as they are used causing the connectors used therewith to fit poorly. Also, if a heavy load is placed on a connector used with a pegboard, there is a substantial risk that the pegboard will fail and drop whatever is hung from the connector. The surface of the pegboard is also difficult to clean because it is rough. Painting the surface helps somewhat but is inconvenient and adds cost.

Traditional wood pegboard is also susceptible to water damage. It tends to absorb water and then collapse, making it unsuited for humid environments and any areas where it may encounter water. Obviously, some of the shortcomings of the pegboard could be overcome by making the pegboard out of a higher grade of particle board or out of plywood or sheets of wood. However, this would significantly increase the cost of the pegboard making it non-competitive.

Pegboard may be made out of other materials to address some of the shortcomings of the wood pegboard. For example, U.S. Pat. Nos. 2,551,539; 3,322,287; 3,452,959; 4,944,416; 5,673,803; and 5,927,517 all disclose pegboard or merchandise display boards which may be made out of various types of plastics. Plastic has several advantages over wood. It tolerates water without degradation, does not easily splinter or crack, and does not require paint to give it a pleasing appearance. However, plastic presents numerous challenges if it is to be used as a pegboard material. First, it is necessary to minimize the amount of plastic used in pegboard in order to make it price competitive with wood pegboard. Traditional wood pegboard is very inexpensive.

The cost of plastic pegboard depends on several things, though the primary consideration is the amount of plastic required to make the pegboard. Therefore, reduction in the total amount of material required also reduces the cost of the resulting product.

Generally, if plastic pegboard is designed in the same way as wooden pegboard, it cannot be price competitive. Traditional wood pegboard has a generally uniform thickness, and the apertures defined through the wood pegboard have a constant cross section. If plastic pegboard is made with a constant thickness, it generally must be made rather thick to be sufficiently stiff and strong. This requires a large amount of plastic material, leading to a costly product. Such a thick plastic pegboard also would be very heavy, making handling and mounting difficult. If the plastic pegboard is made thinner to reduce its cost and weight, the performance of the pegboard may be affected. U.S. Pat. No. 2,551,539 to Horton discloses a uniform thickness display board which may be made out of a plastic material. The uniform thickness of the board causes it to either be costly and heavy, or too thin and flexible for optimal performance.

U.S. Pat. No. 3,322,287 to Ragir attempts to overcome some of the problems associated with a plastic display board such as shown in the Horton patent. The Ragir design is designed to allow thin flexible sheets to be mounted flush with a mounting surface. The area of the panels immediately surrounding each aperture is raised so as to allow the back side of a hook to reside behind the raised portion. These locally raised areas may be stiffened by stiffening ribs. The Ragir design may have benefits for certain applications, but, unlike traditional pegboard, it is not self-supporting and therefore cannot be used for many applications. Also, the Ragir design is complexly shaped making it difficult to mold.

U.S. Pat. No. 3,452,959 to Ishikawa discloses a plastic pegboard wherein individual panels are provided that are designed to be interconnected to form larger panels. The Ishikawa pegboard has areas of increased thickness where the apertures are defined in order to increase the strength of the apertures. While this may allow the use of less plastic material without limiting the strength of the apertures, it does nothing to address the stiffness of the overall panel. This necessarily limits the total size of the individual panels. In the illustrated embodiments Ishikawa shows small panels that are interconnected. However, if the panels were made larger, the face of the panels would become flexible making them unsuitable for many applications. U.S. Pat. No. 4,944,416 to Petersen et al. discloses a display panel with elongated horizontal slots defined in its face. The panel has an expanded plastic foam core with a laminate on its face. This combination may provide some weight advantages by the combination of a stronger laminate with a foam core. However, the cost and complexity of such a system is undesirable.

U.S. Pat. No. 5,673,803 to Burback discloses a plastic pegboard system with shortcomings similar to the Horton design. Specifically, the pegboard has a uniform thickness leading to the undesirable tradeoff between high weight and cost or insufficient strength and thickness. The Burback design may partially overcome the strength limitations by the use of specifically designed hooks and pegs. However, this eliminates one of the primary advantages of traditional pegboard. That is, traditional pegboard works with a large variety of hooks and. pegs that are interchangeable and readily available.

U.S. Pat. No. 5,927,517 to Lipman et al. also discloses a plastic pegboard system. The primary point of the Lipman invention is stability enhancing collars on the rear of the pegboard. This allows the use of elongated hooks without additional stability enhancers. The Lipman invention once again fails to address the need for reduction in the amount of plastics required for acceptable strength and weight.

In light of the above, there is a need for a pegboard made out of improved material that has improved performance characteristics.

SUMMARY OF THE INVENTION

The present invention overcomes many of the shortcomings of the prior art by providing a plastic pegboard with sufficient stiffness and strength while minimizing the use of plastic material. The plastic pegboard includes a generally flat sheet of plastic with multiple holes defined therethrough at regular intervals. The sheet has a generally smooth front face and an opposed rear face. The rear face includes a ring projecting about each of the multiple holes, as well as multiple ribs extending between at least some of the holes.

DESCRIPTION OF A PREFERRED EMBODIMENT

Figure 1:
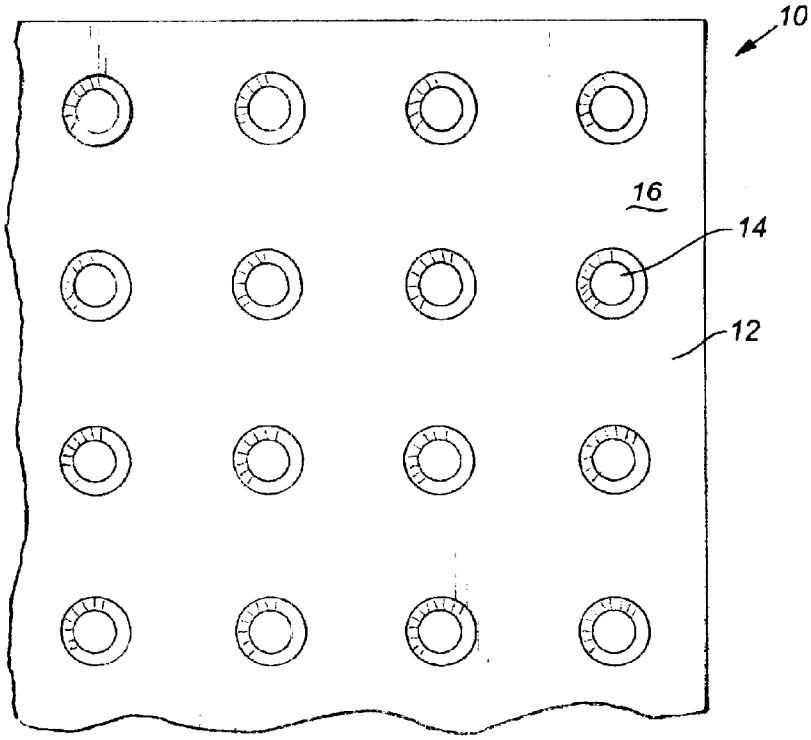
FIG. 1 is a front planar view of the plastic pegboard according to the present invention.
Figure 2:
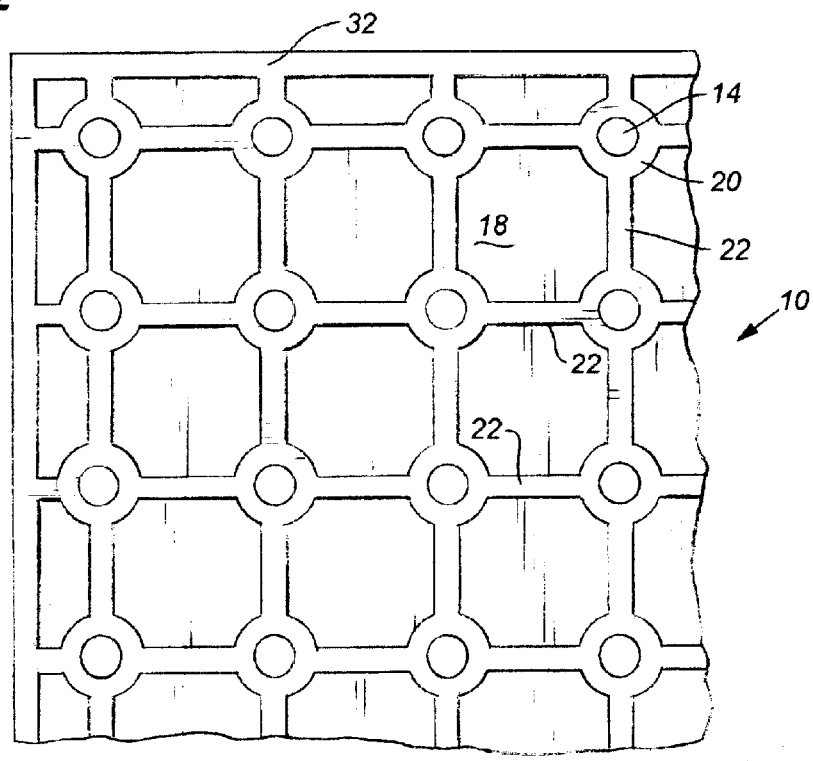
FIG. 2 is a rear planar view of the plastic pegboard.

Referring to FIGS. 1–5, a pegboard 10 that is molded out of plastic is illustrated in the various views. As shown in FIG. 1, the pegboard is a sheet 12 of plastic with holes 14 defined therethrough at regular intervals. The front surface 16 of the plastic is preferably generally smooth with recesses defined around each of the holes in the pegboard. As shown in FIG. 2, the rear surface 18 of the pegboard 10 has a ring 20 of thicker plastic defined around the rear of each of the holes 14 to stiffen and strengthen the holes 14. Because of the rings 20, the holes are deeper and therefore have the strength they would have if the entire pegboard were thicker. A plurality of horizontal and vertical ribs 22 interconnect the rings 20 around the holes 14 to stiffen the sheet of plastic. Like the rings 20, the ribs 22 are formed as areas of thicker plastic. The ribs 22 also allow the pegboard to be thinner than it would otherwise have to be. Making the sheet thinner reduces the amount of material required to make the plastic pegboard and therefore reduces its cost. It also reduces the weight of the pegboard. If the plastic pegboard were made thick enough to be sufficiently stiff but had a smooth rear surface, the pegboard would be significantly heavier making it difficult to handle and install.

Figure 3:
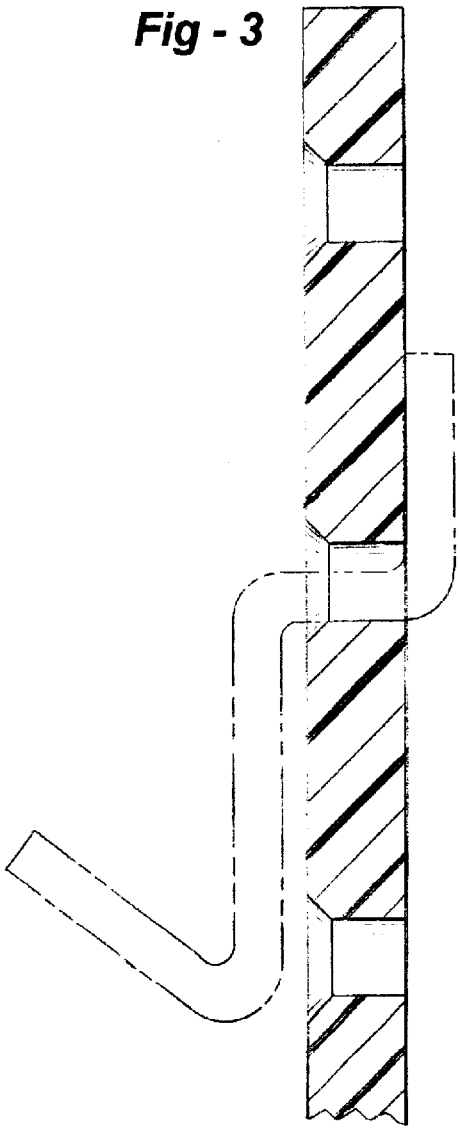
FIG. 3 is a cross-sectional view of the plastic pegboard taken along a vertical axis running through the pegboard holes.

FIG. 3 shows a vertical cross-sectional view of the pegboard of FIGS. 1 and 2, taken through the center line of a series of vertical holes. FIG. 3 illustrates the uniform cross-sectional thickness of the pegboard in this cross section due to the thickened ribs and rings.

Figure 4:
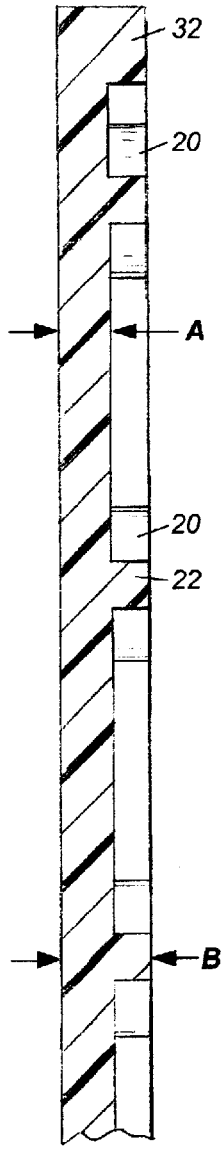
FIG. 4 is a cross-sectional view of the plastic pegboard along a vertical axis intermediate the holes of the pegboard.

FIG. 4 is a vertical cross-sectional view similar to FIG. 3 but taken a t a position intermediate the holes. FIG. 4 shows how the pegboard is thinner between the horizontal ribs 22 and rings 20. As is known to those of skill in the art, the thickness of a plastic molded part depends on many factors, including the necessary strength, the plastic material used, and whether high pressure or low pressure molding is used. In one preferred embodiment of the present invention, the pegboard 10 is molded using a low pressure structural foam injection molding process. When manufactured in this manner, one preferred embodiment of the present invention has a thickness in areas between the ribs of 0.150 inches. The area with this thickness is generally indicated by arrow A in FIG. 4. The ribs 22 and rings 20 create areas of additional thickness. In these areas, the total thickness of the pegboard is approximately 0.240 inches. This area is indicated by letter B in FIG. 4. When used with polyethylene or polypropylene, this combination of thicknesses has been found to provide adequate strength and stiffness while at the same time limiting the total use of plastics such that the cost and weight of the plastic pegboard is competitive. As known to those of skill in the art, high pressure molding may be used to further reduce the thicknesses of the various portions of the pegboard.

Figure 5:
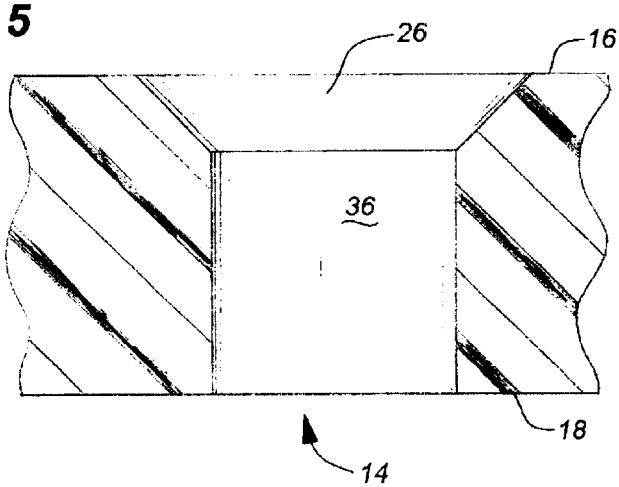
FIG. 5 is a cross-sectional detail view of an aperture in the pegboard.

Referring now to FIG. 5, details of a preferred shape for the holes in the pegboard will be further discussed. As shown, the preferred hole 14 has a cylindrical portion 24 and a tapered portion 26. The cylindrical portion extends from the rear face 18 of the pegboard towards the front face 16. The tapered portion 26 extends inwardly from the front face 16 of the pegboard. The widest part of the tapered portion 26 has an outer diameter somewhat greater than the outer diameter of the cylindrical portion 24 giving a tapered inlet to the hole 14. This tapered inlet provides advantages in inserting a hook through the hole 14. That is, the hole 14 is somewhat countersunk so that it is easier for a tip of a hook to be pushed into the hole. The tapered portion 26 also somewhat reduces the amount of plastic required for molding and improves the flow of plastic in the mold and cooling of the mold. In one preferred embodiment, the tapered portion 26 has walls 28 that taper outwardly at approximately 45°. The tapered portion extends inwardly approximately 0.030 inches from the front face 16 of the pegboard.

Referring again to FIGS. 2 and 4, the pegboard also includes a perimeter rib 32 which extends around the perimeter of the pegboard. This strengthens the edges of the pegboard and also further stiffens the sheets. The pegboard according to the present invention may be provided in any of a number of sizes. According to one preferred embodiment, the pegboard is molded in 4 foot by 8 foot sheets. However, other sizes and shapes may also be molded. In a further preferred embodiment, a double width rib may be extended either horizontally or vertically intermediate the holes of the pegboard. This double width rib provides a location where the pegboard sheet may be cut to a smaller size. For example, on a 4 foot by 8 foot sheet of plastic pegboard, double width vertical and horizontal ribs may be placed at two foot intervals. Then, the pegboard may be cut so as to split this double width rib into two single width ribs. Then, each of the single width ribs defines the edge of a smaller panel.

Figure 6:
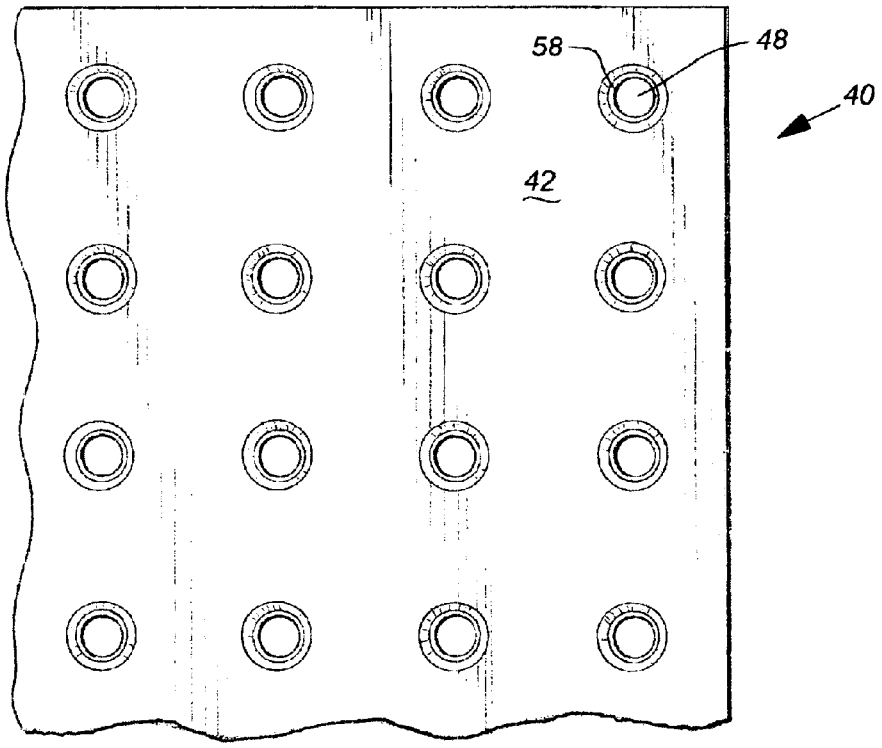
FIG. 6 is a front planar view of a second embodiment of a plastic pegboard according to the present invention.
Figure 7:
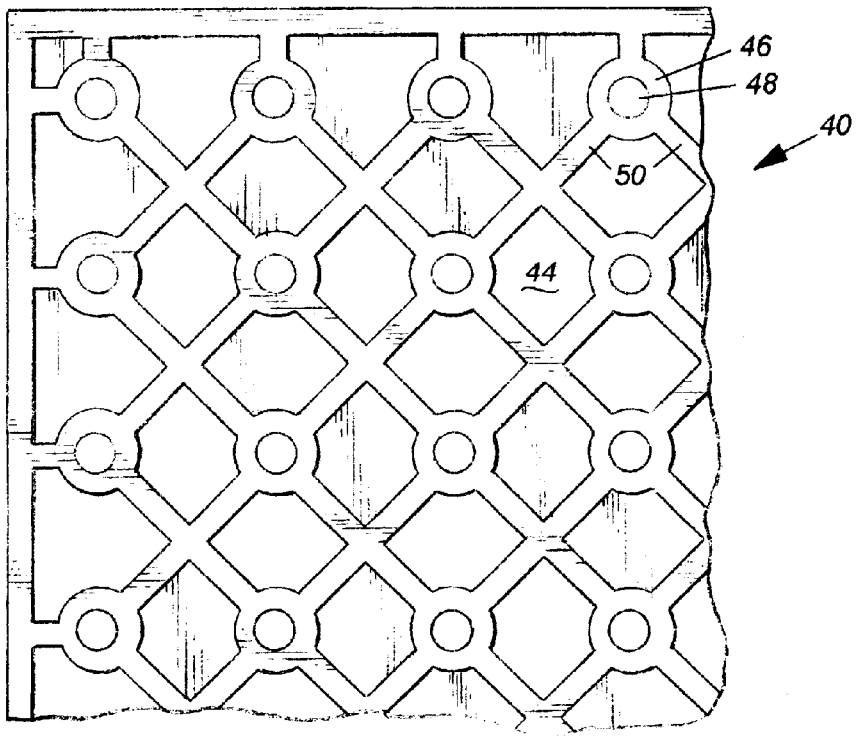
FIG. 7 is a rear planar view of the second embodiment of a pegboard according to the present invention.
Figure 8:
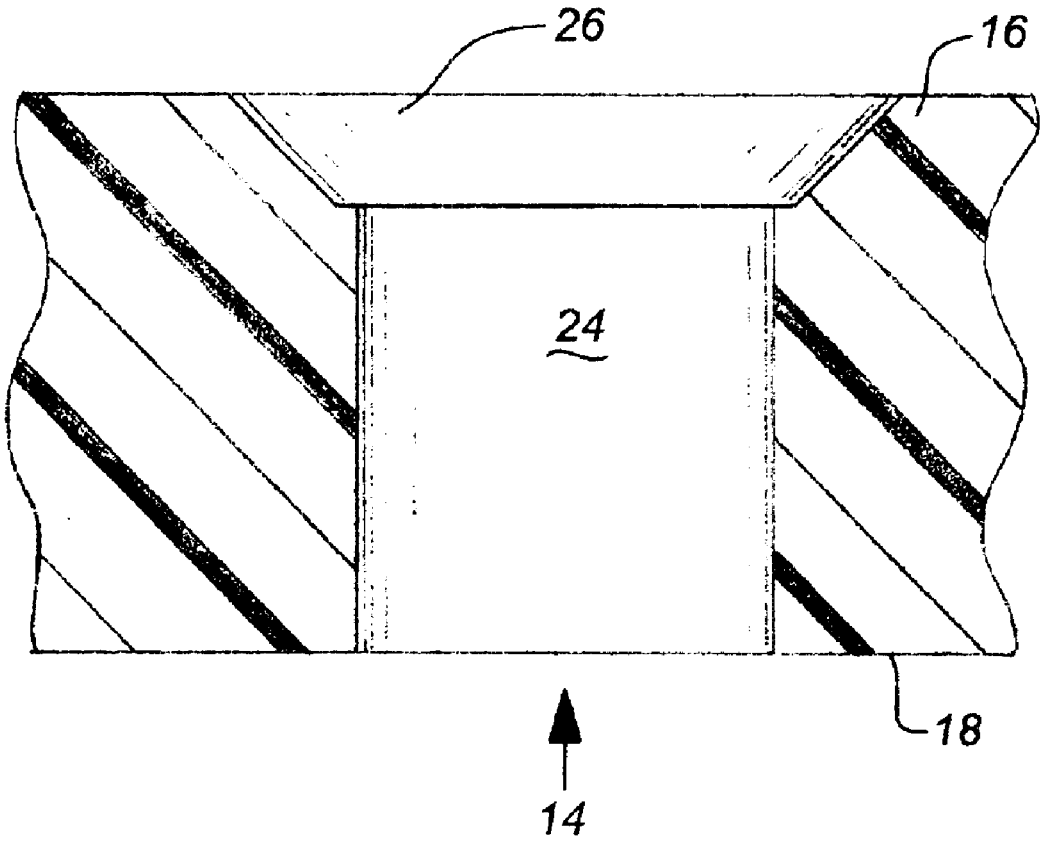
FIG. 8 is a cross-sectional detail view of an aperture in the second embodiment of the present invention.

Referring now to FIGS. 6–8, a second preferred embodiment of a plastic pegboard according to the present invention is generally shown at 40. As shown, the front face 42 of the pegboard 40 appears similar to the front face of the prior embodiment. As with the prior embodiment, the rear face 44 of the pegboard 40 includes rings 46 of thicker plastic surrounding each of the holes 48 in the pegboard 40. However, the stiffening ribs 50 in this embodiment run diagonally interconnecting these rings 46. This illustrates an alternative approach to the stiffening ribs that also provides advantages in allowing the pegboard to be stiffer without the use of additional plastic. As will be clear to those of skill in the art, the ribs may also be arranged in other ways. For example, horizontal and/or vertical ribs may be combined with diagonal ribs. Also, the holes in the pegboard may be arranged differently than the arrangement shown in the figures. These alterations could also be made to the first embodiment.

Referring now to FIG. 8, a further distinction of the second embodiment will be discussed. As with the prior embodiment, each of the holes 48 includes a tapered portion 52 which extends from the front face 42 towards the rear face 44 and a cylindrical portion 54 which extends from the rear face 44 towards the front face 42. However, as shown, the diameter of the narrowest portion of the tapered portion 52 is slightly larger than the diameter of the cylindrical portion 54 creating a step 56. That is, the tapered portion 52 is interconnected with the cylindrical portion 54 by a bottom wall 58. As shown in FIG. 6, the bottom wall 58 is shaped as a small ring concentric with the hole 48. As shown in FIG. 8, the bottom wall 58 lies generally in the same plane as the front face 42 and rear face 44 of the pegboard 40. As will be clear to those of skill in the art of plastic molding, the step 56 provides some advantages in the molding process if the parting line is aligned with the step. The step 56 helps control flash. Depending on the design of the mold and the molding process used, the stepped design of the second embodiment may be used to overcome problems with flash.

As will be clear to those of skill in the art, other variations on the present invention may be made without departing from its teaching. For example, the plastic pegboard may be molded in a variety of colors, including multi-color arrangements that have the look of marble or granite. Also, the various surfaces of the pegboard, especially the front face, may have any of a variety of textures. According to one preferred embodiment, the front surface is given a sand-blasted finish to hide imperfections in the pegboard. This texturing is generally provided in the mold.

I claim:

1. A pegboard molded from plastic comprising:

a generally flat sheet of plastic material with a plurality of holes defined therethrough at regular intervals, each of said holes having an internal diameter, said sheet having a generally smooth front face and an opposing rear face, said rear face including a ring projecting about each of said plurality of holes, each of said rings having an internal diameter essentially the same as the internal diameter of said hole, said rear face further having a plurality of ribs extending between at least some of said holes.

2. The pegboard of claim 1, wherein said generally smooth front face includes countersunk recesses about each of said plurality of holes.

3. The pegboard of claim 1, wherein said ribs comprise vertical ribs interconnecting said rings projecting about each of said plurality of holes.

4. The pegboard of claim 1, wherein said ribs comprise horizontal ribs interconnecting said rings projecting about each of said plurality of holes.

5. The pegboard of claim 1, wherein said ribs comprise horizontal ribs and vertical ribs interconnecting said rings projecting about each of said plurality of holes.

6. The pegboard of claim 1, wherein said ribs comprise diagonal nibs interconnecting said rings projecting about each of said plurality of holes.

7. The pegboard of claim 1, wherein said holes each comprise a cylindrical portion adjacent said rear face of said pegboard and a tapered portion adjacent said front face of said pegboard.

8. A pegboard comprising:

a generally planar member having a plurality of holes defined therethrough, each of said holes having an internal diameter, said planar member having a front face and a rear face;

a plurality of strengthening rings, each ring projecting from said rear face of said planar member, each of said rings having an internal diameter substantially the same as the internal diameter of said holes; and a plurality of strengthening ribs disposed on said rear face of said pegboard each of said ribs extending between two of said holes.

9. The pegboard of claim 8, wherein said front face includes countersunk recesses about each of said plurality of holes.

10. The pegboard of claim 8, wherein said ribs comprise vertical ribs interconnecting said holes.

11. The pegboard of claim 8, wherein said ribs comprise horizontal ribs interconnecting said holes.

12. The pegboard of claim 8, wherein said ribs comprise diagonal ribs interconnecting said holes.

13. The pegboard of claim 8, wherein said holes each comprise a cylindrical portion adjacent said rear face of said pegboard and a tapered portion adjacent said front face of said pegboard.

14. A pegboard comprising:

a generally planar member having a front face and an opposing rear face, a plurality of apertures extending between said front and said rear face, each of said apertures having an internal diameter;

a plurality of strengthening rings, each of said rings projecting from said rear face of said planar member about one of said apertures, each of said rings having an internal diameter substantially the same as the internal diameter of the aperture about which it projects; and a plurality of stiffening ribs disposed on said rear face of said planar member.

15. The pegboard of claim 14, wherein said front face includes countersunk recesses about each of said plurality of apertures.

16. The pegboard of claim 14, wherein said ribs comprise vertical ribs interconnecting said apertures.

17. The pegboard of claim 14, wherein said ribs comprise horizontal ribs interconnecting said apertures.

18. The pegboard of claim 14, wherein said ribs comprise diagonal ribs interconnecting said apertures.

19. The pegboard of claim 14, wherein said apertures each comprise a cylindrical portion adjacent said rear face of said pegboard and a tapered portion adjacent said front face of said pegboard.

20. A pegboard comprising:

a generally planar portion having a front face and a rear face;

a plurality of thickened portions defined on the rear face, each of the thickened portions having a rearmost engagement surface separated from the front face of the generally planar portion by a predetermined distance;

a plurality of essentially constent cross-section holes each defined from the engagement surface of one of the thickened portions to the front face such that the holes have a length essentially equal to the predetermined distance, the essentially constant cross-section defining a minimum cross-sectional dimension along the entire predetermined distance; and a plurality of strengthening ribs defined on the rear face of the generally planar portion.

21. The pegboard of claim 20, wherein the front face includes countersunk recesses about each of the plurality of holes.

22. The pegboard of claim 20, wherein the ribs comprise vertical ribs interconnecting the thickened portions.

23. The pegboard of claim 20, wherein the ribs comprise horizontal ribs interconnecting the thickened portions.

24. The pegboard of claim 20, wherein the ribs comprise diagonal ribs interconnecting the thickened portions.

25. The pegboard of claim 20, wherein the holes each comprise a cylindrical portion adjacent the engagement surface and a tapered portion adjacent the front face of the pegboard.

26. The pegboard of claim 20, wherein each of the thickened portions are generally circular.

27. The pegboard of claim 20, wherein the predetermined distance is approximately 0.24 inches.

28. The pegboard of claim 20, wherein the front face and the rear face are separated by a distance of approximately 0.15 inches in between said thickened portions.

* * * * *

UNITED STATES PATENT AND TRADEMARK OFFICE

CERTIFICATE OF CORRECTION

PATENT NO. : 6,481,584 B1
DATED : November 19, 2002
INVENTOR(S) : Cantley

It is certified that error appears in the above-identified patent and that said Letters Patent is hereby corrected as shown below:

Column 2,
Line 47, starting with "U.S. Pat. No." make a new paragraph.

Column 4,
Line 5, replace "a t a" with -- at a --.

Column 6,
Line 2, replace "nibs" with -- ribs --.
Line 66, replace "constent" with -- constant --.

Signed and Sealed this

Twenty-second Day of July, 2003

JAMES E. ROGAN
*Director of the United States Patent and Trademark Office*